United States Patent [19]

Langen

[11] 4,159,610

[45] Jul. 3, 1979

[54] CLOSURE MECHANISM FOR CLOSING END OF LOADED CARTONS

[75] Inventor: Marinus J. M. Langen, Rexdale, Canada

[73] Assignee: H. J. Langen & Sons Ltd., Rexdale, Canada

[21] Appl. No.: 872,999

[22] Filed: Jan. 27, 1978

[51] Int. Cl.[2] ..... B65B 5/04; B65B 7/20; B65B 63/00; B65B 1/22

[52] U.S. Cl. ..... 53/525; 53/252; 53/284; 53/374

[58] Field of Search ..... 53/250, 251, 252, 284, 53/374, 375, 376, 525, 566

[56] References Cited

U.S. PATENT DOCUMENTS

| | | | |
|---|---|---|---|
| 2,631,767 | 3/1953 | Banks | 53/252 X |
| 2,642,212 | 6/1953 | Currivan | 53/252 |

*Primary Examiner*—Robert Louis Spruill
*Attorney, Agent, or Firm*—Fetherstonhaugh & Co.

[57] ABSTRACT

In a packaging machine having a first conveyor for supporting and transporting a plurality of loaded cartons to an end closure station, the cartons being supported with an open end disposed in a substantially vertical plane, the improvement of a mechanism for reorienting the carton as it is driven towards the end closure station so that the open end is relocated so as to open upwardly and the weight of the contents of the package is directed away from the open end so that during subsequent closure, the contents of the package will not interfere with the movement of the end flaps to the closed position. Preferably a vibrating mechanism is also provided for vibrating the cartons after they have been reoriented so that the contents of the package are urged to settle in a direction away from the open end.

12 Claims, 6 Drawing Figures

CLOSURE MECHANISM FOR CLOSING END OF LOADED CARTONS

FIELD OF INVENTION

This invention relates to improvements in the closure mechanism for closing end loaded cartons. In particular, the present invention relates to improvements in the closure mechanism for closing the ends of end loaded cartons formed in a wrap-around carton forming machine.

PRIOR ART

Difficulty has been experienced in attempting to close the ends of cartons when the cartons are horizontally oriented because there is a tendency for the contents of the carton to become entangled with the end closure flaps. When the contents of the carton are enclosed in a loose-fitting bag, an end of the bag can easily project outwardly through an open end of the carton when the carton is located in a generally horizontal configuration with the open end being vertically oriented. Thus, when the end closure flaps are folded inwardly to close the end of the carton, they may encounter the end of the bag which is located within the carton and the bag can prevent the correct sealing of the end closure flaps.

It has been found that this difficulty can be overcome in the apparatus of the present invention by reorienting the carton so that the final end which is to be closed is oriented to open upwardly and the weight of the contents of the carton is applied downwardly away from the open end so that the contents will tend to move away from the open end to avoid interference with the end closure flap. Because the contents of the package located within the carton may be rather light in weight, a vibrating mechanism is preferably provided to vibrate the carton so that the contents will settle in a direction away from the upwardly open end which is to be closed.

It is an object of the present invention to provide a mechanism for use in a carton and loading machine for reorienting cartons having a vertically oriented open end to a position in which the open ends open upwardly.

It is a further object of the present invention to provide a mechanism of the type described above which includes means for vibrating the containers after they have been oriented to cause the contents thereof to settle in a direction away from the upwardly opening end thereof.

SUMMARY OF INVENTION

According to one aspect of the present invention, there is provided in a packaging machine having a first conveyor for supporting and transporting a plurality of loaded cartons to an end closure station, the cartons being supported by the first conveyor in a configuration in which each carton has an open end and a closed end disposed opposite one another and oriented in substantially vertical planes and means for laterally discharging said cartons from said first conveyor, the improvement of a transfer mechanism including transfer conveyor means having a forward run, at least a portion of which extends in a side-by-side relationship with at least a portion of said first conveyor for receiving cartons which are laterally displaced from said first conveyor, said transfer mechanism being adapted to reorient said cartons to a second position in which the open ends thereof open upwardly, closure means for closing the open ends of said cartons after the cartons are located in said second position, and drive means for driving said transfer conveyor at a speed synchronized with the speed of said first conveyor.

According to a further aspect of the present invention, there is provided in a wrap-around carton forming machine having a plurality of mandrel buckets mounted on a first conveyor for receiving an article to be wrapped and transporting the article through a wrapping station in which a carton blank is wrapped around each mandrel bucket and the article contained therein, the first conveyor supporting and transporting the loaded partially formed cartons to an end closure station and means for laterally discharging said partially formed cartons from said mandrel buckets, the improvement of a transfer mechanism including transfer conveyor means having a forward run, at least a portion of which extends in a side-by-side relationship with at least a portion of said first conveyor for receiving cartons which are laterally displaced from said first conveyor, said transfer mechanism being adapted to reorient said cartons to a second position in which the open ends thereof open upwardly, closure means for closing the open ends of said cartons after the cartons are located in said second position, and drive means for driving said transfer conveyor at a speed synchronized with the speed of said first conveyor.

PREFERRED EMBODIMENT

The invention will be more clearly understood after reference to the following detailed specification read in conjunction with the drawings, wherein FIG. 1 is a pictorial view of a portion of a wrap-around carton forming machine constructed in accordance with an embodiment of the present invention;

The transfer mechanism illustrated in the preferred embodiment is designed for use in association with a wrap-around carton forming machine of the type described in my U.S. Pat. No. 3,968,623 of July 13, 1976.

Figure 1:
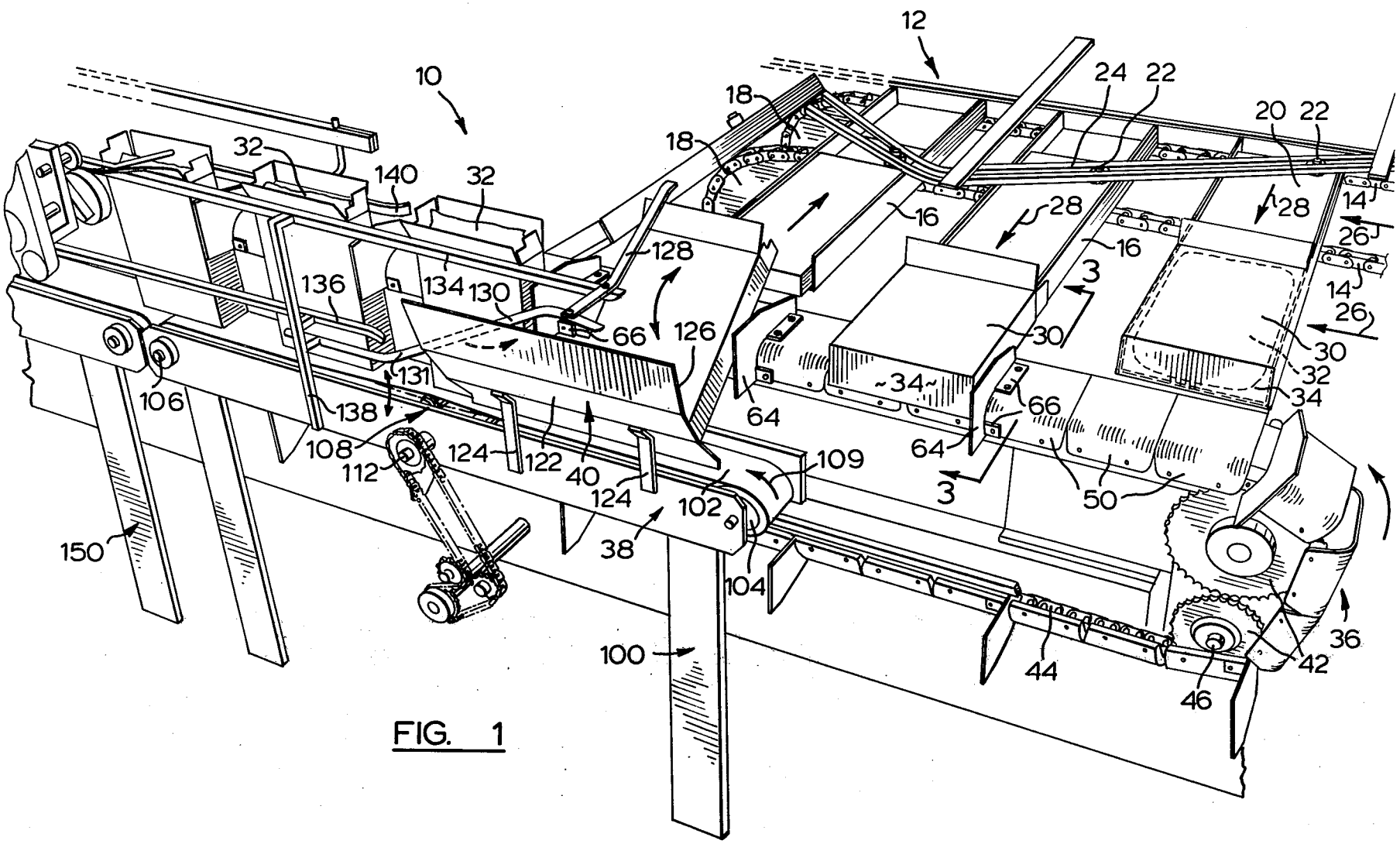

With reference to FIG. 1 of the drawings, the reference 10 refers generally to the transfer mechanism which is located towards the discharge end of the main conveyor 12 of a wrap-around carton forming machine of the type described in my prior U.S. Pat. No. 3,968,623. The main conveyor 12 includes a pair of chains 14 which extend around sprockets 18. A plurality of mandrel buckets 16 are mounted at spaced intervals along the chains 14 and open upwardly therefrom. A pusher unit 20 is slidably mounted in each mandrel bucket 16 and has a cam follower 22 projecting upwardly therefrom, the cam follower 22 riding in cam track 24 to control the movement of the pusher unit 20 with respect to its associated mandrel bucket.

As the mandrel buckets are driven towards the end closure station in the direction of arrows 26, the pusher units 20 are initially driven laterally in the direction of the arrows 28 to discharge the carton 30 and its contents 32, the end 34 of each carton having been previously closed by an end closure mechanism such as that described in U.S. Pat. No. 3,968,623.

The transfer mechanism of the present invention includes an intermediate conveyor generally identified by the reference numeral 36, a receiving conveyor generally identified by the reference numeral 38, and a guide assembly generally identified by the reference numeral 40.

Figure 2:
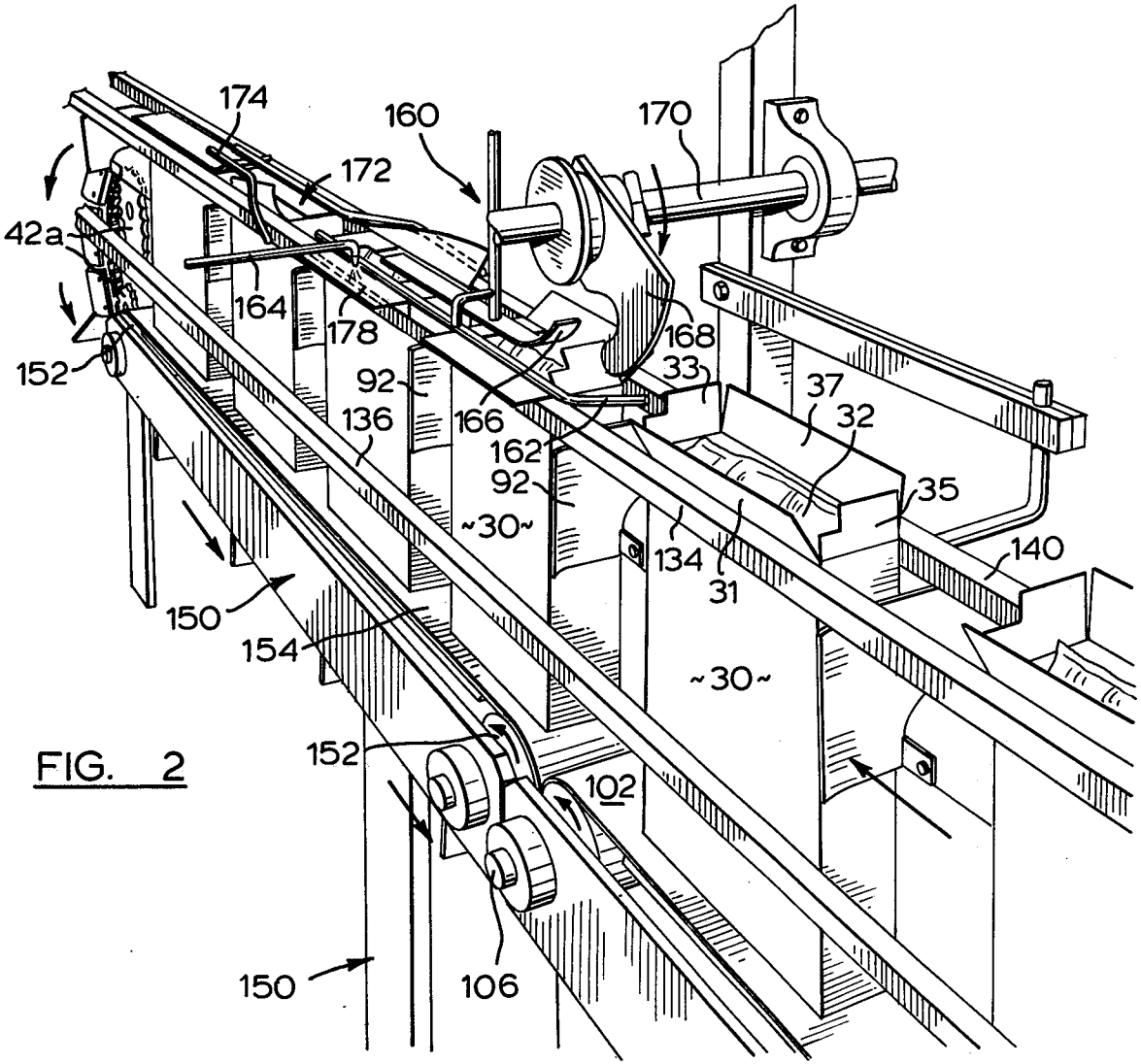
FIG. 2 is a pictorial view of a portion of the machine of FIG. 1 showing a mechanism for closing the open end of the carton.

The intermediate conveyor mechanism includes two conveyor chains 44 (FIG. 5) which extend around two sets of sprockets 42 (only one set of which is shown) at one end thereof and two sets of sprockets 42*a* (only one set of which is shown in FIG. 2) at the other end thereof. The chains 44 are driven by the sprockets 42 mounted on drive shaft 46 which is rotatably driven at a speed synchronized with the speed of the conveyor chains 14.

Figure 4:
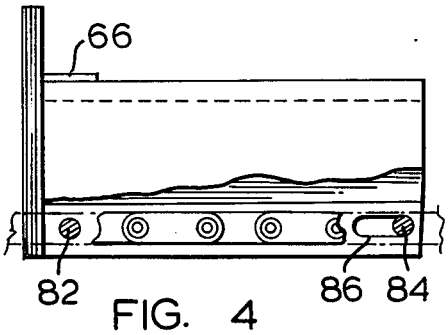
FIG. 4 is a sectional view of a segment of the intermediate conveyor taken along the line 4—4 of FIG. 3.
Figure 3:
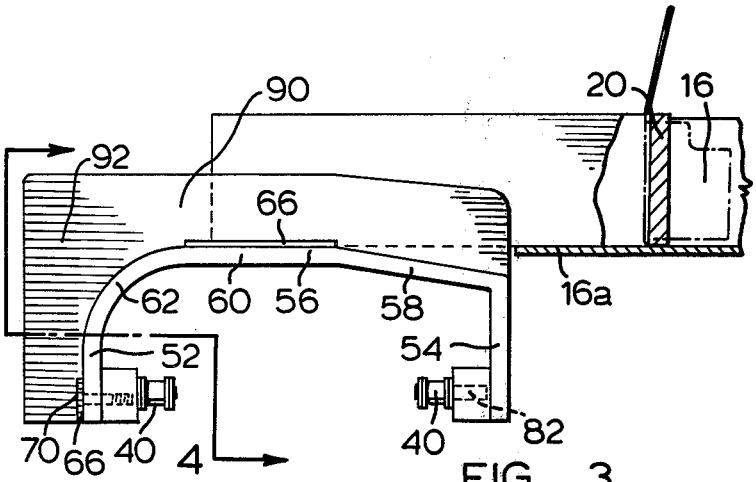
FIG. 3 is a sectional view of the intermediate conveyor taken along the line 3—3 of FIG. 1.
Figure 5:
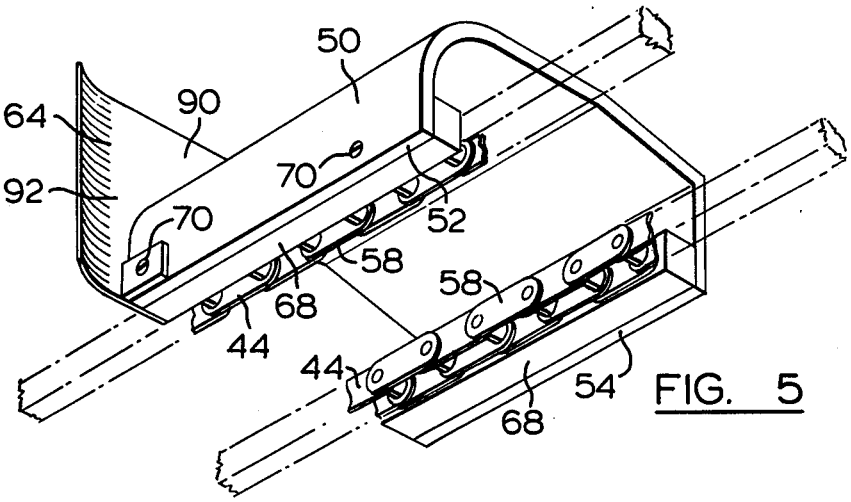
FIG. 5 is a pictorial view of the underside of a segment of the intermediate conveyor.

A plurality of platform segments 50 are mounted on chains 44. As shown in FIGS. 3, 4 and 5 of the drawings, each of the platform segments 50 has a pair of oppositely disposed legs 52 and 54 and a platform panel 56 extending therebetween. The panel 56 has a first section 58 which is downwardly inclined towards the leg 54 so that at the leg 54 it is located in a plane which is spaced below the bottom wall 16*a* of the mandrel 16. Thus, the platform is provided with a ramp face disposed towards the mandrel 16 which facilitates the transfer of the carton from the mandrel to the intermediate conveyor. The platform also has a generally flat portion 60 and an arcuately curved portion 62 extending outwardly and downwardly from the flat portion 60 to the leg 52 to form a fulcrum surface about which a carton may pivot during the reorientation of the carton.

As shown in FIG. 1 of the drawings, a pusher blade 64 is mounted at the leading edge of every third platform segment 50. It will be noted that the pusher blades 64 are positioned so as to be located only slightly downstream from the trailing edge of the mandrel forming bucket 16 so that they will engage the trailing end wall of the articles 30 as soon as the articles are discharged from the mandrel. The pusher blades are spaced a short distance rearwardly from the mandrel so as to provide sufficient clearance to ensure that the articles may be discharged without running into the pusher blades.

It will be understood that the pusher blades 64 may be mounted on every segment 50 or on every second segment, third segment, fourth segment, etc. as required, depending upon the proportions of the mandrel forming bucket 16. As shown in FIGS. 1, 3, 4 and 5 of the drawings, the pusher blades 64 have short flanges 66 projecting rearwardly therefrom and overlying the leg 52 and horizontal platform surface 60 and being secured thereto by suitable set-screws or the like.

A pair of spacer bars 68 are located on the inner face of the legs 52 and 54 and are secured thereto by countersunk screws 70. The platform segments 50 are secured with respect to the chains 44 so that the chains are free to conform to the configuration of the sprockets 42. This is achieved by connecting the forward bar 82 of each chain to its adjacent spacer 68 and by locating the trailing bar 84 of one link of the chain in a slot 86 formed in the spacer bars 68. The slot 86 permits the bar 84 to move forwardly to allow the chain to follow the curvature of the sprockets 42 and 42*a* in use.

Each of the pusher blades 64 has a portion 90 which projects upwardly from its associated segment and a portion 92 which projects laterally from its associated segment so that the pusher unit may engage a carton as it is moved laterally across the segment and after it is reoriented in the vertical position.

Figure 6:
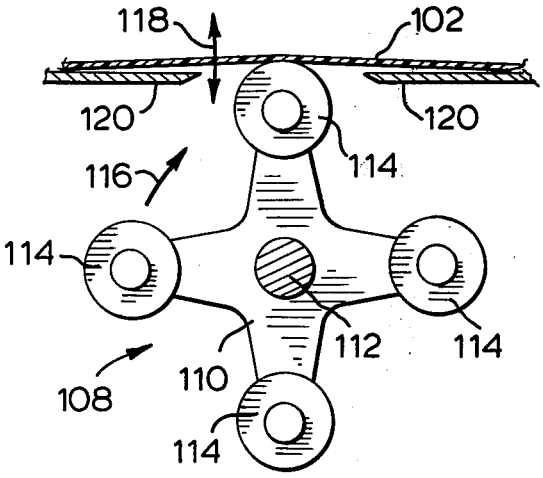
FIG. 6 is a partially sectioned end view of the mechanism for imparting a vibration to the receiving conveyor of the transfer conveyor mechanism.

As previously indicated, the transfer mechanism also includes a receiving conveyor 38. The receiving conveyor 38 includes a frame generally identified by the reference numeral 100 which supports a flexible conveyor belt 102 in a position extending around guide rollers 104 at opposite ends thereof. One of the rollers 104 is mounted on a rotatably driven drive shaft 106 which serves to drive the conveyor 102 in the direction of the arrow 109. It will be noted that the receiving conveyor 102 is located at a level below the level of the platform of the intermediate conveyor. In many applications, the laterally discharging cartons 30 will tend to pivot about the arcuate shaped shoulder 62 of the segments 50 under the influence of its own weight by reason of the fact that the center of gravity of the container may be located laterally outwardly from the horizontal extending portion 60 of the platform formed by the segments 50. In order to impart the vibration to the conveyor belt 102, a vibrating mechanism 108 is provided. As shown in FIGS. 1 and 6 of the drawings, the vibrating mechanism 108 consists of a spider wheel 110 mounted to be rotatably driven by shaft 112. Rollers 114 are rotatably mounted at the outer end of each arm of the spider wheel 110. As the spider wheel 110 is rotatably driven in the direction of the arrow 116, it engages the conveyor belt 102 and causes the belt 102 to vibrate to and fro in the direction of the arrows indicated by the reference numeral 118. Support plates 120 located below the belts 102 limit the extent of vibration imparted to the conveyor to prevent excessive vibration of the conveyor 102.

As previously indicated, the guide assembly 40 is provided for guiding the discharging carton from the intermediate conveyor to the receiving conveyor. The guide assembly 40 consists of a guide plate 122 which is mounted on brackets 124 which are secured to the frame 100 and plow blades 128 and 130. The guide plate 122 has a guide face 126 which is shaped to direct the discharging end of the carton downwardly towards the conveyor belt 102. The plow blade 128 is supported by the leading end of a plow blade 130 and a frame member 134. The plow blade 128 is upwardly inclined in a direction towards the intermediate conveyor 36 and projects above the intermediate conveyor 36 to deflect the open end of the transversely discharging carton downwardly and thereby assist the reorientation of the carton as it is directed transversely across the intermediate conveyor. The plow blade 130 has a downwardly inclined portion 131 which serves to ensure that the closed outer end of the laterally discharging carton is directed downwardly towards the conveyor if the weight of the overhanging portion of the carton is not sufficient to achieve the required reorientation.

The guide rail 134, together with a guide rail 136, is mounted on support posts 138 (only one of which is shown) which are secured to the frame member 100. During movement of the container 30 along the conveyor 102 and the end closure conveyor 154, the guide rails 134 and 136 serve to maintain the position of the outermost side panel of the cartons and the legs 52 of the intermediate conveyor segments 50 bear against the other side panel of the containers with the laterally projecting portions 92 of the pusher blades 64 engaging the trailing end panels of the containers 30. An additional guide rail 140 is provided opposite the guide rail 134 to provide complete support for the upper end of the container during the closure operation.

To support the cartons during movement through the end closure mechanism, a frame 150 is provided which supports rollers 152 about which the end closure conveyor belt 154 extends. One of the rollers 152 is rotatably driven so as to drive the conveyor belt 154 through the end closure station.

The end closure mechanism of the present invention is generally identified by the reference numeral 160. The mechanism includes a first plow blade 162 which serves to engage a first flap 31 to fold it outwardly into a position extending along the guide rail 134 so that an adhesive may be applied by adhesive applicator 164 to the inner face thereof. The leading end lug 33 is plowed inwardly by means of a plow blade 166 and a trailing lug 35 is kicked inwardly by kicker blade 168 which is mounted to be rotatably driven on shaft 170. The flap 37 is folded inwardly to overlie lugs 33 and 35 by plow blade 172. Thereafter, the flap 31 is released by the plow blade 162 and engaged by a plow blade 174 so as to be folded into an overlying relationship with respect to the flap 37 to be adhesively secured thereto by the adhesive applied along adhesive strip 178 by adhesive applicator 164. Thereafter the cartons may be discharged from the carton loading device in any suitable manner.

In use, the loaded cartons with one end closed are discharged laterally from the carton loading machine onto the intermediate conveyor so that a portion thereof will extend transversely outwardly from the intermediate conveyor to be engaged by plow blades 130 and 134 and guide plate 122 or to fall under its own weight to a position in which the closed end 34 rests on conveyor 102. The conveyor 102 and pusher blades 64, together with guide rails 134 and 140, serve to support the container in the upwardly opened position as it is driven along conveyor 102 and subsequent conveyor 154. As the carton is driven along conveyor 102, it is driven through a vibrating station which precedes the upper end closure station. The conveyor belt 102 is vibrated in the vibrating station to cause the contents 32 to settle towards the lower end of the carton. In this regard reference is made to FIG. 1 of the drawings in which it will be seen that in the carton which is approaching the vibrating station the contents 32 are shown to project a substantial distance above the upper edges of the side walls of the carton whereas after the carton is passed through the vibrating station, the contents 32 have settled to a level below the upper edges of the side walls of the container, with the result that the contents do not interfere with the subsequent closing operation.

By rearranging the carton so that it opens upwardly, it is possible to employ a coupon inserting mechanism to insert coupons into the upwardly open end of the carton before the end is closed.

From the foregoing it will be apparent that a more reliable end closure of the cartons can be achieved by rearranging the cartons so that the second end is closed when the cartons are vertically oriented, the vibrating mechanism of the receiving conveyor serving to cause the contents of the carton to settle towards the closed lower end thereof.

While the mechanism for closing the second end of the carton is described above with reference to a wrap-around carton forming machine of the type described by U.S. Pat. No. 3,968,623 it is to be noted that this mechanism may be used to advantage to achieve closure of the second end of an end loading carton loaded in any one of a number of end loading machines.

Although the end closure mechanism may be adapted for use in association with many different types of carton end loaders, it is particularly suitable for use with a wrap-around carton forming machine of the type described in my prior U.S. Pat. No. 3,968,623 which has an appropriate mechanism for achieving the required lateral discharge of the carton from the mandrels after closure of one end of the carton.

What I claim as my invention is:

1. In a packaging machine having a first conveyor for supporting and transporting a plurality of loaded cartons to an end closure station, the cartons being supported by the first conveyor in a configuration in which each carton has an open end and a closed end disposed opposite one another and oriented in substantially vertical planes and means for laterally discharging said cartons from said first conveyor, the improvement of;

(a) a transfer mechanism including transfer conveyor means having a forward run, means mounting at least a portion of said forward run in a side-by-side relationship in substantially the same plane with at least a portion of said first conveyor for receiving cartons which are laterally displaced from said first conveyor, said transfer mechanism including means to reorient said cartons to a second position in which the open ends thereof open upwardly, (b) closure means for closing the open ends of said cartons after the cartons are located in said second position, and (c) drive means for driving said transfer conveyor at a speed synchronized with the speed of said first conveyor.

2. A packaging machine as claimed in claim 1, wherein said transfer conveyor means comprises:

(a) an intermediate conveyor having first and second longitudinally extending side edges, at least a portion of said first side edge extending in a side-by-side relationship with a portion of said first conveyor to receive cartons as they are laterally discharged from said first conveyor as aforesaid, and (b) a receiving conveyor having a forward run extending parallel to at least a portion of said intermediate conveyor, the forward run of said receiving conveyor being disposed a substantial distance below said second edge of said intermediate conveyor and projecting laterally outwardly therefrom, and (c) guide means for reorienting said cartons as aforesaid as the cartons are discharged laterally from the transfer conveyor to the receiving conveyor to locate the closed ends of each carton on said receiving conveyor whereby said receiving conveyor supports the weight of the carton and its contents.

3. A packaging machine as claimed in claim 2 including means for imparting a vibration to said forward run of said receiving conveyor whereby the cartons supported thereby are vibrated to cause the contents thereof to settle towards said closed end and away from said open end to avoid interference with the end closure flaps of the carton during closure of the cartons as aforesaid.

4. A packaging machine as claimed in claim 2 wherein said guide means includes deflector means disposed laterally outwardly from said intermediate conveyor and above said receiving conveyor for deflecting the closed ends of the cartons downwardly towards the receiving conveyor as they are discharged from said intermediate conveyor.

5. A packaging machine as claimed in claim 4 wherein said second longitudinally extending side edge of said intermediate conveyor is formed with an arcuate curvature extending outwardly and downwardly from said receiving conveyor to facilitate the reorientation of said cartons.

6. A packaging machine as claimed in claim 2 including pusher blade means mounted on said intermediate conveyor, said pusher blade means having a first portion projecting upwardly from said intermediate conveyor for engaging cartons when they extend transversely thereacross and a second portion projecting laterally from said second edge thereof for engaging cartons supported by said receiver conveyor.

7. In a wrap-around carton forming machine having a plurality of mandrel buckets mounted on a first conveyor for receiving an article to be wrapped and transporting the article through a wrapping station in which a carton blank is wrapped around each mandrel bucket and the article contained therein, the first conveyor supporting and transporting the loaded partially formed cartons to an end closure station and means for laterally discharging said partially formed cartons from said mandrel buckets, the improvement of:

(a) a transfer mechanism including transfer conveyor means having a forward run, means mounting at least a portion of said forward run in a side-by-side relationship in substantially the same plane with at least a portion of said first conveyor for receiving cartons which are laterally displaced from said first conveyor, said transfer mechanism including means to reorient said cartons to a second position in which the open ends thereof open upwardly, (b) closure means for closing the open ends of said cartons after the cartons are located in said second position, and (c) drive means for driving said transfer conveyor at a speed synchronized with the speed of said first conveyor.

8. A packaging machine as claimed in claim 7 wherein said transfer conveyor means comprises:

(a) an intermediate conveyor having first and second longitudinally extending side edges, at least a portion of said first side edge extending in a side-by-side relationship with a portion of said first conveyor to receive cartons as they are laterally discharged from said first conveyor as aforesaid, (b) a receiving conveyor having a forward run extending parallel to at least a portion of said intermediate conveyor, the forward run of said receiving conveyor being disposed a substantial distance below said second edge of said intermediate conveyor and projecting laterally outwardly therefrom, and (c) guide means for reorienting said cartons as aforesaid as the cartons are discharged laterally from the transfer conveyor to the receiving conveyor to locate the closed ends of each carton on said receiving conveyor whereby said receiving conveyor supports the weight of the carton and its contents.

9. A packaging machine as claimed in claim 8 including means for imparting a vibration to said forward run of said receiving conveyor whereby the cartons supported thereby are vibrated to cause the contents thereof to settle towards said closed end and away from said open end to avoid interference with the end closure flaps of the carton during closure of the cartons as aforesaid.

10. A packaging machine as claimed in claim 8 wherein said guide means includes deflector means disposed laterally outwardly from said intermediate conveyor and above said receiving conveyor for deflecting the closed ends of the cartons downwardly towards the receiving conveyor as they are discharged from said intermediate conveyor.

11. A packaging machine as claimed in claim 10 wherein said second longitudinally extending side edge of said intermediate conveyor is formed with an arcuate curvature extending outwardly and downwardly from said receiving conveyor to facilitate the reorientation of said cartons.

12. A packaging machine as claimed in claim 8 including pusher blade means mounted on said intermediate conveyor, said pusher blade means having a first portion projecting upwardly from said intermediate conveyor for engaging cartons when they extend transversely thereacross and a second portion projecting laterally from said second edge thereof for engaging cartons supported by said receiver conveyor.

* * * * *